US010801530B2

(12) United States Patent
Lecourtier et al.

(10) Patent No.: US 10,801,530 B2
(45) Date of Patent: Oct. 13, 2020

(54) TELESCOPIC ACTUATOR WITH AUTOMATIC LOCKING

(71) Applicant: SAFRAN LANDING SYSTEMS, Velizy Villacoublay (FR)

(72) Inventors: Gilbert Lecourtier, Moissy-Cramayel (FR); Arnaud Le Breton, Moissy-Cramayel (FR)

(73) Assignee: SAFRAN LANDING SYSTEMS, Velizy Villacoublay (FR)

( * ) Notice: Subject to any disclaimer, the term of this patent is extended or adjusted under 35 U.S.C. 154(b) by 0 days.

(21) Appl. No.: 16/410,063

(22) Filed: May 13, 2019

(65) Prior Publication Data

US 2019/0353187 A1 Nov. 21, 2019

(30) Foreign Application Priority Data

May 18, 2018 (FR) ..... 18 54162

(51) Int. Cl.
*F15B 15/26* (2006.01)
*F15B 15/16* (2006.01)

(52) U.S. Cl.
CPC ..... *F15B 15/261* (2013.01); *F15B 15/16* (2013.01)

(58) Field of Classification Search
CPC ..... F15B 15/26; F15B 15/261
See application file for complete search history.

(56) References Cited

U.S. PATENT DOCUMENTS 2,702,024 A * 2/1955 Harold ..... F15B 15/261 92/5 L
2,851,995 A * 9/1958 Westcott, Jr. ..... F15B 15/261 92/26
3,072,105 A * 1/1963 Johnson ..... F15B 15/261 92/26
3,315,568 A * 4/1967 Fredd ..... F15B 15/261 91/44

(Continued)

FOREIGN PATENT DOCUMENTS

GB 1032243 A 6/1966

OTHER PUBLICATIONS

French Preliminary Search Report dated Feb. 6, 2019.

*Primary Examiner* — Dustin T Nguyen
(74) *Attorney, Agent, or Firm* — Sughrue Mion, PLLC

(57) ABSTRACT

The invention relates to a telescopic actuator comprising a cylinder (1) having a closed end (2) and an open end (3) for passing a hollow rod (4) mounted to slide axially in the cylinder. The actuator includes a central support (10) that extends from the closed end of the cylinder inside the rod and that carries obstacles (15) that are movable radially between a setback position leaving the rod free to slide and a projecting position in which the obstacles are engaged in a groove (9) in the rod in order to lock the rod axially relative to the cylinder, the flanks of the obstacles and of the groove being shaped so as to prevent any setting back of the obstacles by movement of the rod, the obstacles being arranged at the ends of spring blades (14) extending longitudinally and arranged to urge the obstacles from the setback position towards the projecting position, the central support carrying controlled means (20) for flexing the blades in order to cause the obstacles to be set back towards the setback position.

4 Claims, 5 Drawing Sheets

(56) References Cited

U.S. PATENT DOCUMENTS

| | | | | | |
|---|---|---|---|---|---|
| 3,415,167 | A * | 12/1968 | Champagne | B64C 25/22 | 92/26 |
| 4,188,860 | A * | 2/1980 | Miller | F15B 15/261 | 92/15 |
| 7,650,978 | B2 * | 1/2010 | Ruhringer | F15B 15/261 | 188/265 |
| 9,140,048 | B2 * | 9/2015 | Langford | E05F 15/53 | |
| 9,676,374 | B2 * | 6/2017 | Scherer | B60T 1/005 | |

* cited by examiner

TELESCOPIC ACTUATOR WITH AUTOMATIC LOCKING

The invention relates to a telescopic actuator with automatic locking.

BACKGROUND OF THE INVENTION

The invention relates to a telescopic actuator fitted with a device for locking in position two elements that are movable relative to each other along an axial direction, e.g. a rod mounted to slide telescopically in a cylinder. Certain actuators are fitted with a device for locking the rod in position, in particular in the retracted position or in the extended position.

Claw locking devices comprise firstly a sleeve, usually installed on the rod, and having its tubular wall cut out to form a certain number of elastically deformable claws that are cantilevered in an axial direction, being terminated by hooks, and secondly an anchor portion arranged on the cylinder including an annular setback for receiving the hooks. The anchor portion includes a step for causing the claws to flex when the step passes under the hooks of the claws. The step is followed by an annular setback into which the hooks engage in order to enable the claws to return to the rest position once the hooks have gone past the step. A locking piston that was pushed back against a return spring by the hooks as they were passing over the step then moves axially to cover the hooks of the claws and thus prevent the claws from flexing, so that the hooks are held captive in the annular setback, thereby locking the rod of the actuator in position in the cylinder.

In order to unlock the rod, it then suffices to cause the locking piston to reverse so as to allow the claws to flex once more, and to cause the anchor portion to move away from the sleeve. The locking piston is moved against the return spring by means of fluid under pressure, which also moves the rod, so there is no need to provide the locking piston with individual control.

Segment locking devices comprise segments that are mounted to move radially on the cylinder between a setback position in which the rod is free to slide in the cylinder, and an engaged position in which the segments are pushed by the piston, itself pushed by a spring, so as to penetrate into a housing provided in the rod or the associated piston. Once the segments are engaged, the piston passes over the segments so as to prevent them from being set back, thereby locking the rod in position relative to the cylinder.

In both circumstances, locking depends on moving a locking piston. The blocking members (hooks of the claws, segments) are disengaged when the locking piston is moved in reverse, and this is made possible by slopes provided on the portions that are in contact so as to enable the blocking members to be pushed back when the rod is moved in the cylinder.

In certain circumstances, it has been observed that malfunctions prevent the locking position from covering the blocking member, thus making it impossible for the rod to be blocked positively relative to the cylinder.

OBJECT OF THE INVENTION

The invention seeks to propose a telescopic actuator provided with an automatic locking device without a locking piston.

SUMMARY OF THE INVENTION

In order to achieve this object, there is provided a telescopic actuator comprising a cylinder having a closed end and an open end for passing a hollow rod mounted to slide axially in the cylinder. According to the invention, the actuator includes a central support that extends from the closed end of the cylinder inside the rod and that carries obstacles that are movable radially between a setback position leaving the rod free to slide and a projecting position in which the obstacles are engaged in a groove in the rod in order to lock the rod axially relative to the cylinder, the flanks of the obstacles and of the groove being shaped so as to prevent any setting back of the obstacles by movement of the rod, the obstacles being arranged at the ends of spring blades extending axially and arranged to urge the obstacles from the setback position towards the projecting position, the central support carrying controlled means for flexing the blades in order to cause the obstacles to be set back towards the setback position.

Thus, locking is ensured automatically merely by the obstacles engaging in the groove in the rod under the action of the blades, the obstacles being held in position by the blades without there being any need to confirm this engagement by a locking piston. Any attempt at moving the rod is then blocked by the co-operation between the obstacles and the flanks of the groove. Unlocking requires prior operation of means for causing the blades to flex, thereby disengaging the obstacles, and allowing the rod to move freely.

In a preferred embodiment, the controlled means for causing the blades to flex comprise an unlocking piston mounted to slide axially on the central support between a rest position in which the unlocking position is remote from the obstacles, and an unlocking position in which a conical hollow end of the unlocking piston co-operates with fingers secured to each of the obstacles in order to cause the blades to flex and thus the obstacles to be set back from the projecting position to the setback position.

DESCRIPTION OF THE FIGURES

The invention can be better understood in the light of the following description of a particular embodiment of the invention, given with reference to the figures of the accompanying drawings, in which.

DETAILED DESCRIPTION OF THE INVENTION

Figure 1:
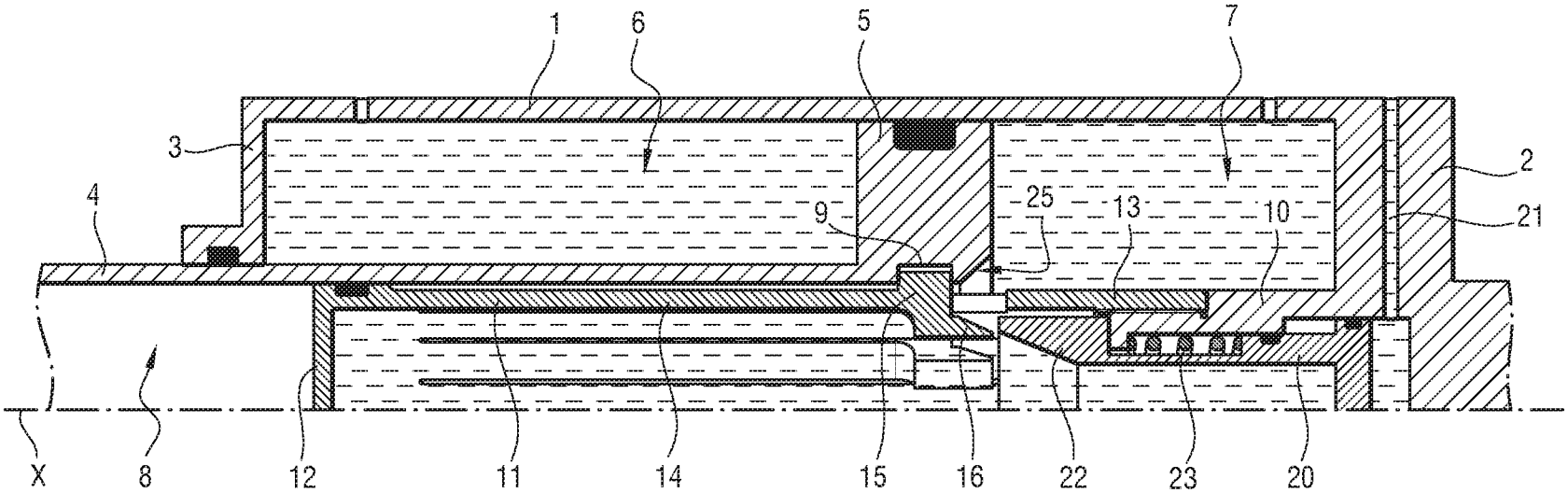
FIG. 1 is a section view of a hydraulic actuator provided with a locking device of the invention, the rod being shown in the locking position.
Figure 2:
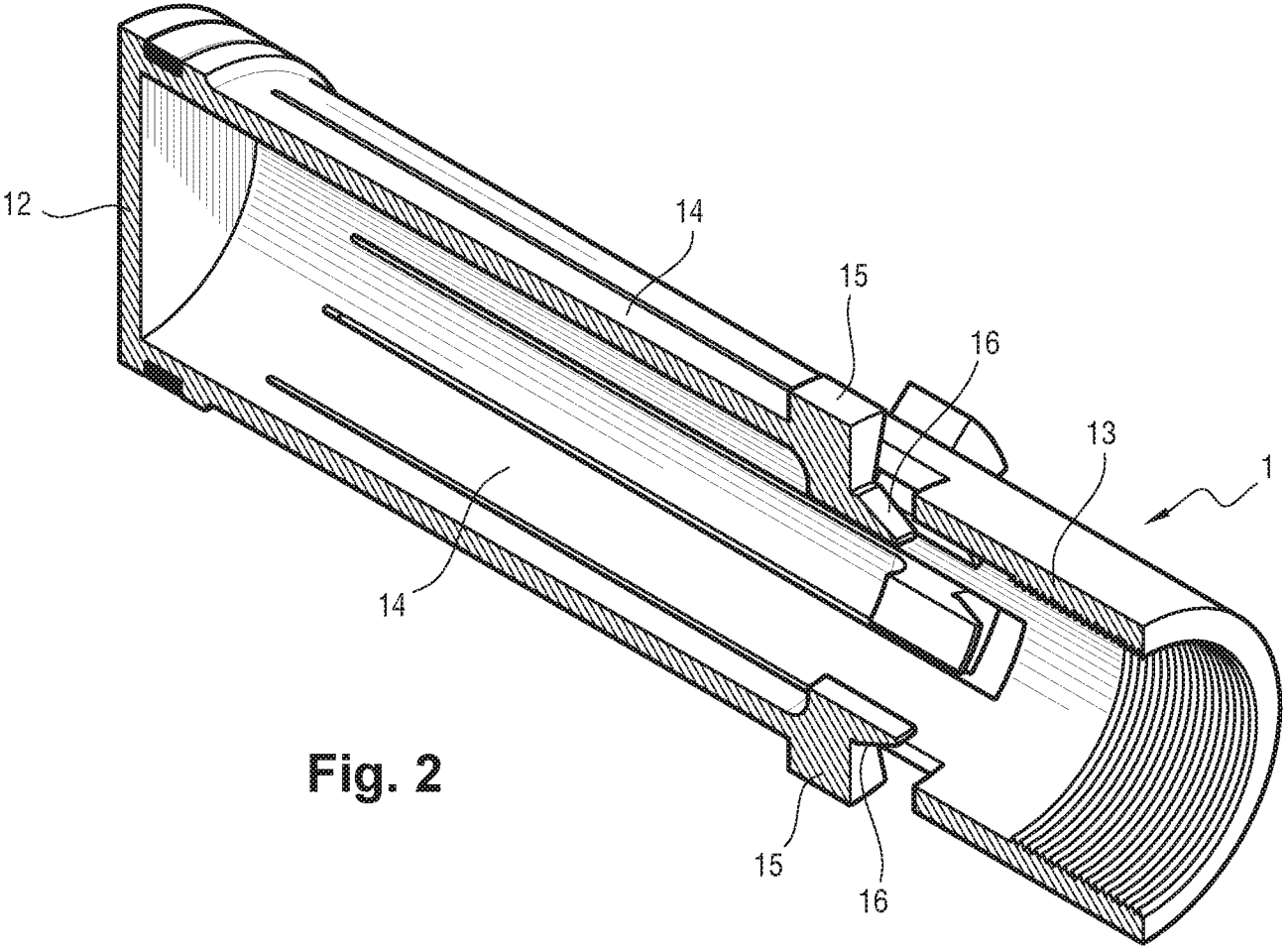
FIG. 2 is a fragmentary section view of the sleeve carrying the obstacles of the locking device.

With reference to FIG. 1, the telescopic actuator of the invention comprises a cylinder 1 that is closed at one end by a leaktight end wall 2 and at another end by an end wall 3 that is pierced so as to pass a rod 4 secured to a piston 5 that is mounted to slide in sealed manner inside the cylinder 1 along an axis X in order to define a retraction hydraulic chamber 6 and an extension hydraulic chamber 7. The rod 4 is caused to move relative to the cylinder 1 by pressurizing one or the other of the chambers. In this example, the rod 4 and the piston 5 are hollow and they define an internal axial housing 8 that presents, level with the piston 5, a groove 9 having flanks that are substantially perpendicular to the axis X. The actuator also includes a central support 10 that extends from the leaktight end wall 2 in an axial direction and that has a locking sleeve 11 screwed thereon, as can be seen more particularly in FIG. 2, which sleeve extends inside the axial housing 8 of the rod-and-piston assembly.

The locking sleeve 11 is generally tubular in shape, being terminated at one end by an end wall 12 and at the other end by a tapped endpiece 13 for screwing onto the central support 10. The locking sleeve 11 has a tubular wall in which longitudinal blades 14 are cut out, each presenting a first end secured to the locking sleeve 11 and an end that is free and that carries an obstacle 15 that projects outwards from the locking sleeve 11 when the blades 14 are in the rest state, as shown herein. A finger 16 extends longitudinally from each obstacle 15 in the inside of the locking sleeve 11. The blades 14 can flex towards the inside of the locking sleeve 11 so that the obstacles 15 are moved radially towards a setback position in which they do not project from the outside surface of the locking sleeve 11. The blades 14 then exert a return force on the obstacles 15 urging them towards the projecting position.

Returning to FIG. 1, it can be seen that the obstacles 15 of the locking sleeve 11 are engaged in the groove 9 in the piston 5 so that the rod 4 is locked in position in the cylinder 1. The flanks of the obstacles 15 and the flanks of the groove 9 are shaped so as to prevent any setting back of the obstacles by movement of the rod 4, such that the position shown in FIG. 1 is a stable position.

Figure 3:
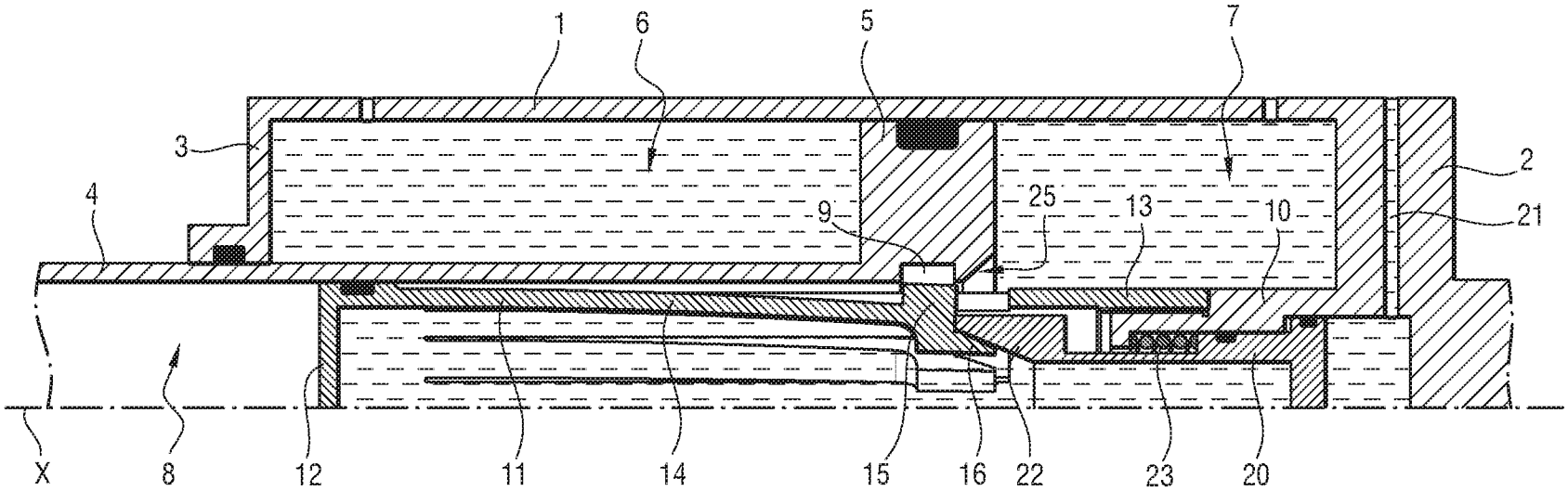
FIG. 3 is a view similar to the view of FIG. 1 showing the unlocking piston being activated.

In order to unlock the rod 4, an unlocking piston 20 is mounted to slide in leaktight manner in the central support 10 in order to define therein an unlocking chamber 21 that is pressurized in order to cause the unlocking piston 20 to move towards an unlocking position in which a conical hollow end 22 of the piston co-operates with the fingers 16 in order to force the blades 14 to flex, thereby setting back the obstacles 15 so that the rod 4 is released and can slide freely, as shown in FIG. 3. When the unlocking chamber 21 is not pressurized, a return spring 23 moves the unlocking piston 20 towards a rest position in which the unlocking piston 20 is remote from the fingers 16, as shown in FIG. 1.

Figure 4:
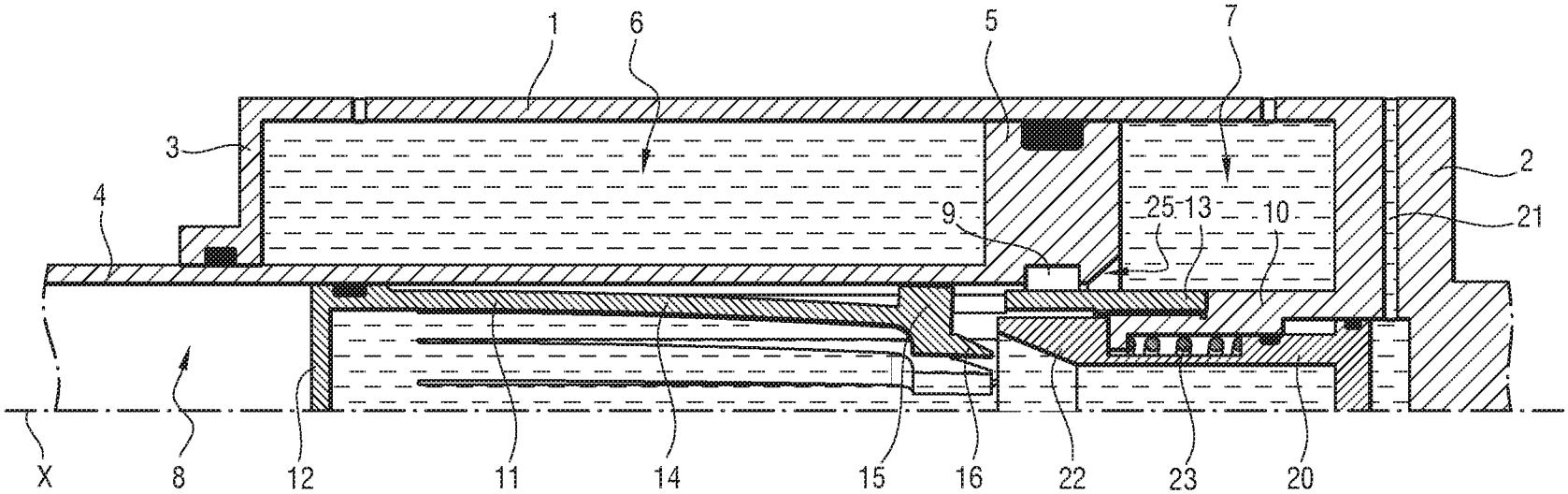
FIG. 4 is a view similar to the view of FIG. 1, showing the rod retracted before the locking position.
Figure 5:
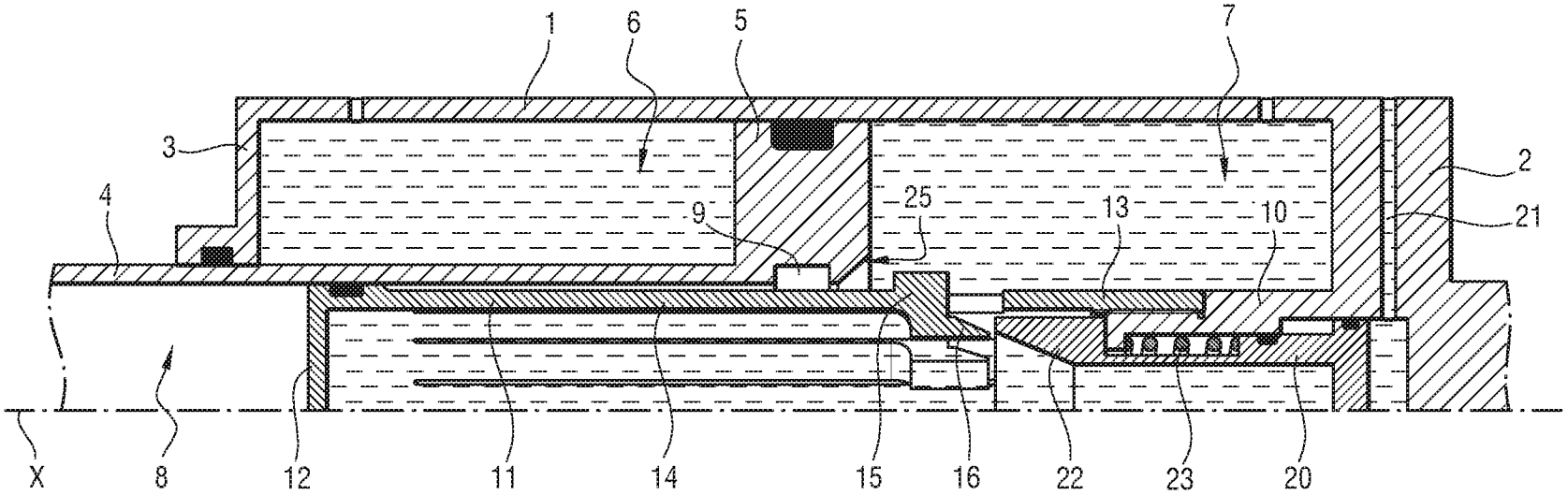
FIG. 5 is a view similar to the view of FIG. 1, showing the rod extended beyond the locking position.

It should be observed that the rod 4 is locked automatically as soon as it reaches the locking position in which the groove 9 comes into register with the obstacles 15. In the situation shown in FIG. 4, in which the rod 4 has been retracted and lies behind the locking position, the obstacles 15 remain set back, being pressed against the inside surface of the axial housing 8 in the rod 4. When the extension chamber 7 is pressurized, the rod 4 extends until the flexed blades 14 push the obstacles 15 towards their positions projecting into the groove 9, as soon as the groove comes into register with the obstacles 15. In the situation shown in FIG. 5, in which the rod 4 has been extended and lies beyond the locking position, the obstacles 15 have returned to their projecting positions under the action of the blades, since the rod 4 and the piston 5 are no longer in register with the obstacles 15. When the retraction chamber 6 is pressurized, the rod 4 retracts and the piston 5 has a deflection cone 25 in its rear face to force the obstacles 15 to be set back by flexing the blades 14 until the obstacles pass under the inside wall of the rod 4. The flexed blades 14 push the obstacles 15 towards their positions projecting into the groove 9 as soon as the groove comes into register with the obstacles 15.

The invention is not limited to the above description, but on the contrary covers any variant coming within the ambit defined by the claims.

In particular, although the invention is described herein in application to a hydraulic actuator, the invention could equally well be applied to an electromechanical actuator or to an actuator of hybrid technology. By way of example, the unlocking piston could be actuated merely by an electromagnet.

Although in this example the locking position is a position that is intermediate between the retracted position and the extended position of the actuator, the locking device of the invention could be used for locking in one or the other of those two extreme positions.

The invention claimed is:

1. A telescopic actuator comprising:

a cylinder having a closed end and an open end for passing a hollow rod mounted to slide axially in the cylinder; and a central support that extends from the closed end of the cylinder inside the rod and that carries obstacles that are movable radially between a setback position leaving the rod free to slide and a projecting position in which the obstacles are engaged in a groove in the rod in order to lock the rod axially relative to the cylinder, flanks of the obstacles and of the groove being shaped so as to prevent any setting back of the obstacles by any movement of the rod, the obstacles being arranged at ends of spring blades extending longitudinally and arranged to urge the obstacles from the setback position towards the projecting position, the central support carrying a device that flexes the blades in response to a command in order to cause the obstacles to be set back towards the setback position.

2. A telescopic actuator according to claim 1, wherein the device that flexes the blades comprises:

an unlocking piston mounted to slide axially on the central support between a rest position in which the unlocking position is remote from the obstacles, and an unlocking position in which a conical hollow end of the unlocking piston co-operates with fingers secured to each of the obstacles in order to cause the blades to flex and thus the obstacles to be set back from the projecting position to the setback position.

3. An actuator according to claim 1, wherein the rod is associated with a piston, the groove for receiving the obstacles being made level with the piston.

4. An actuator according to claim 1, wherein the rod is associated with a piston that includes a deflection cone for forcing the obstacles to be set back by flexing the blades while the rod is being retracted.

* * * * *